US006199633B1

(12) United States Patent
Longbottom

(10) Patent No.: US 6,199,633 B1
(45) Date of Patent: Mar. 13, 2001

(54) METHOD AND APPARATUS FOR INTERSECTING DOWNHOLE WELLBORE CASINGS

(76) Inventor: James R. Longbottom, P.O. Box 1115, 25311 Winding Creek Ct., Magnolia, TX (US) 77353

( * ) Notice: Subject to any disclaimer, the term of this patent is extended or adjusted under 35 U.S.C. 154(b) by 0 days.

(21) Appl. No.: 09/384,619

(22) Filed: Aug. 27, 1999

(51) Int. Cl.[7] ..... E21B 17/10

(52) U.S. Cl. ..... 166/242.6; 166/117.6; 166/50; 175/45; 175/171

(58) Field of Search ..... 166/268, 50, 117.5, 166/117.6, 242.6; 175/45, 61, 171; 403/328, 327

(56) References Cited

U.S. PATENT DOCUMENTS 593,190 * 11/1897 Bernhardt ..... 242/317
2,616,633 * 11/1952 Reynolds ..... 285/317
3,518,840 * 7/1970 Mertz ..... 175/61
3,635,036 * 1/1972 Hooper, Jr. ..... 175/61
4,016,942 * 4/1977 Wallis, Jr. et al. ..... 175/45
4,458,767 * 7/1984 Hoehn, Jr. ..... 175/45
4,893,810 * 1/1990 Lee ..... 403/328
5,074,360 * 12/1991 Guinn ..... 166/50
5,485,089 * 1/1996 Kuckes ..... 175/45
5,944,108 * 8/1999 Baugh et al. ..... 166/117.6

* cited by examiner

*Primary Examiner*—Lanna Mai
(74) *Attorney, Agent, or Firm*—Marvin J. Marnock

(57) ABSTRACT

The present invention provides a method and apparatus for mechanically interconnecting a lateral wellbore liner to a main, or parent, wellbore casing. The present invention further provides a method of wellbore construction for the construction of multiple wellbores which are interconnected downhole to form a manifold of pipelines in a reservoirs of interest. Provision is made for flow controls, sensors, data transmission, power generation, and other operations positioned in the lateral wellbores during the drilling, completion and production phases of such wellbores.

9 Claims, 8 Drawing Sheets

FIG. 2
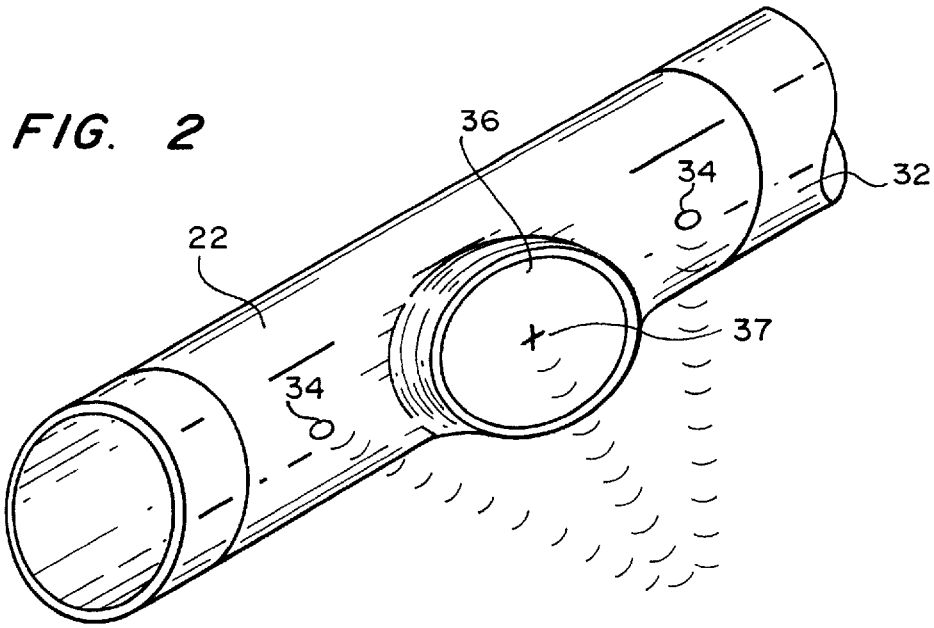
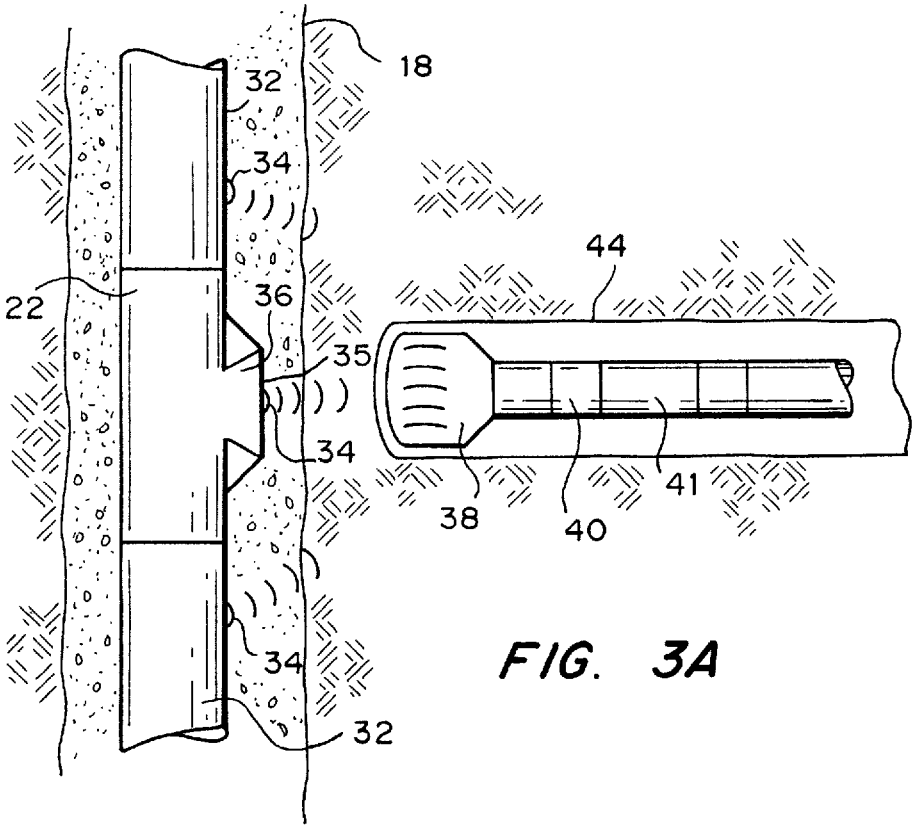
FIG. 3A

FIG. 4
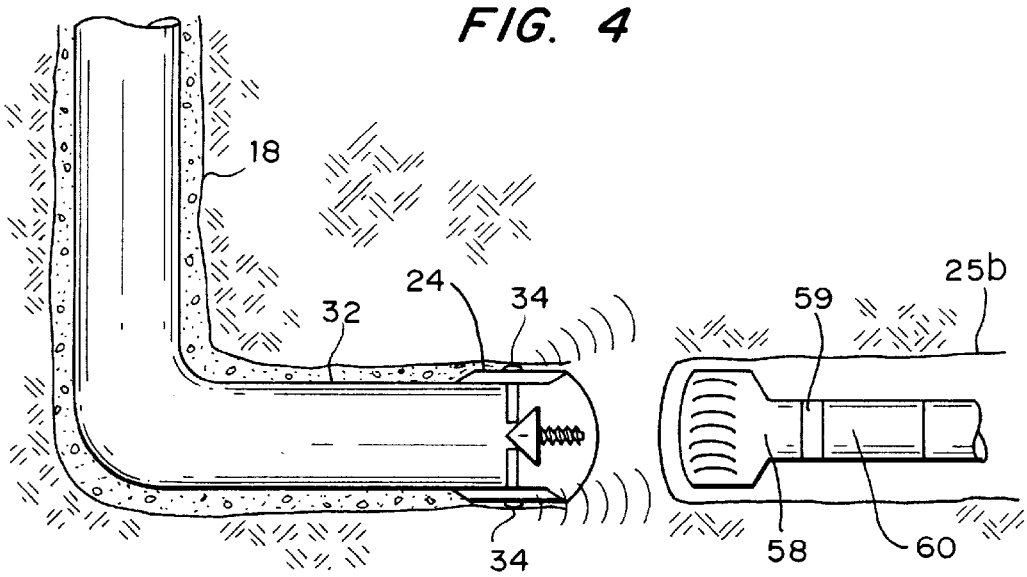
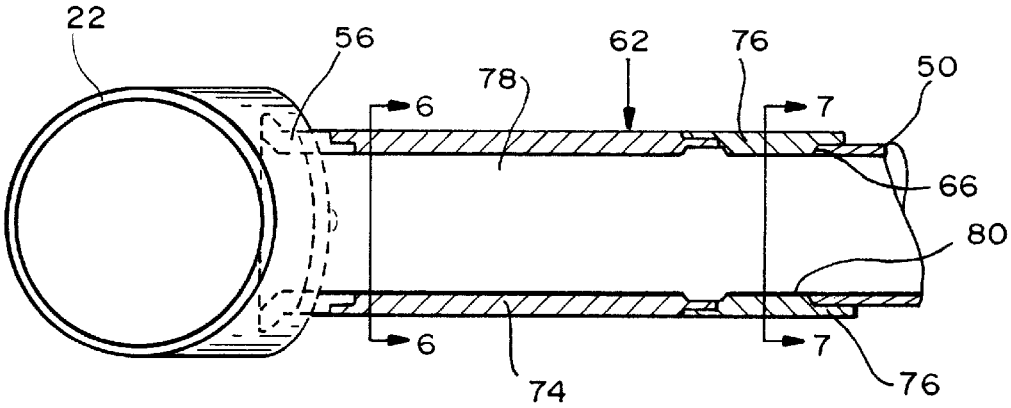
FIG. 5

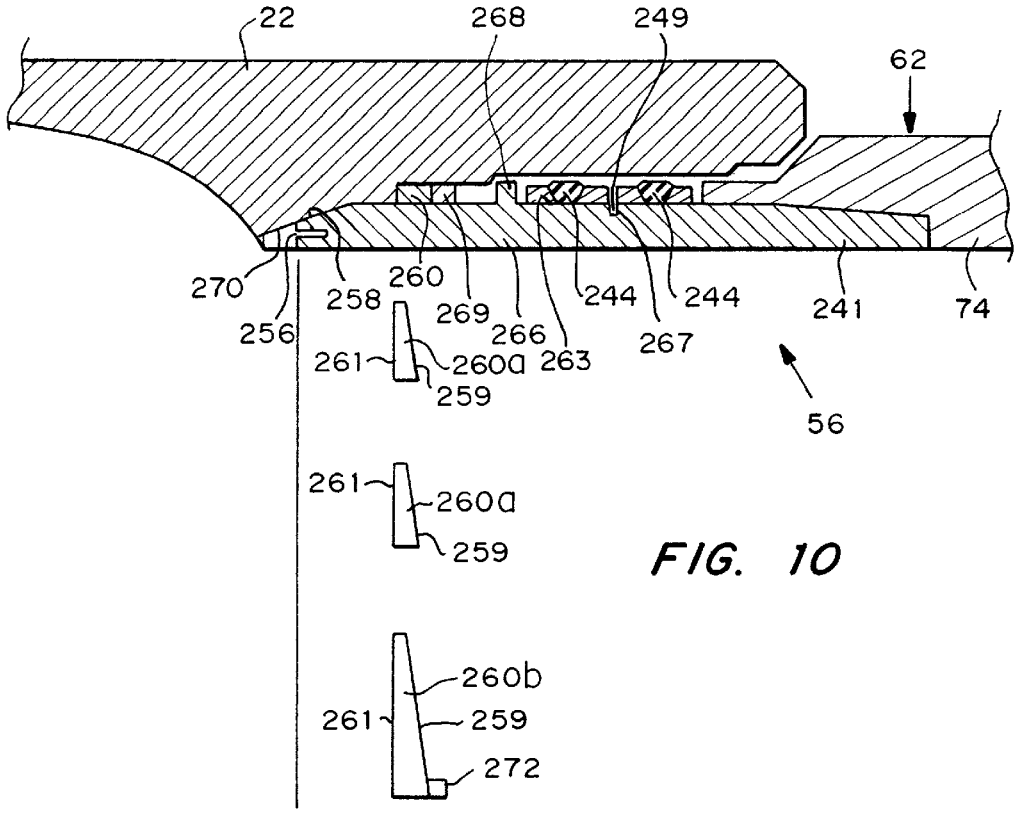
FIG. 10
FIG. 11
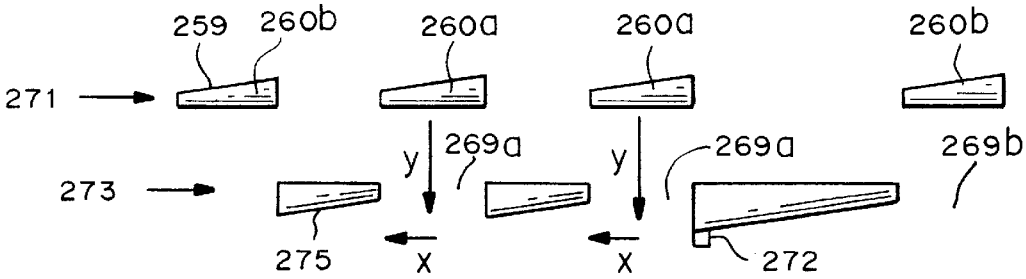

METHOD AND APPARATUS FOR INTERSECTING DOWNHOLE WELLBORE CASINGS

BACKGROUND OF THE INVENTION

1. Field of the Invention

The present invention relates generally to wellbore construction and more particularly to the construction of multiple wellbores which are interconnected downhole to form a manifold of pipelines in the reservoirs of interest. Provision is made for flow controls, sensors, data transmission, power generation, and other operations positioned in the lateral wellbores during the drilling, completion and production phases of such wellbores.

2. Background of the Related Art

To obtain hydrocarbons such as oil and gas, wellbores or boreholes are drilled from one or more surface locations into hydrocarbon-bearing subterranean geological strata or formations (also referred to herein as reservoirs). A large proportion of the current drilling activity involves drilling deviated and/or substantially horizontal wellbores extending through such reservoirs. To develop an oil and gas field, especially offshore, multiple wellbores are drilled from an offshore rig or platform stationed at a fixed location. A template is placed on the sea bed, defining the location and size of each of the multiple wellbores to be drilled. The various wellbores are then drilled from the template along their respective pre-determined wellpaths (or drilling course) to their respective reservoir targets. Frequently, ten to thirty offshore wells are drilled from an offshore rig stationed at a single location. In some regions such as the North Sea, as many as sixty separate wellbores have been drilled from an offshore platform stationed at a single location. The initial drilling direction of several thousand feet of each such wellbore is generally vertical and typically lies in a non-producing (non-hydrocarbon bearing) formation.

Each wellbore is then completed to produce hydrocarbons from its associated subsurface formations. Completion of a wellbore typically includes placing casings through the entire length of the wellbore, perforating production zones, and installing safety devices, flow control devices, zone isolation devices, and other devices within the wellbore. Additionally each wellbore has associated wellhead equipment, generally referred to as a "tree" and includes closure valves, connections to flowlines, connections for risers and blowout preventors, and other devices.

As an example, ten wellbores may be drilled from a single offshore platform, each wellbore having a nine-inch internal diameter. Assuming that there is no production zone for the initial five thousand feet for any of the wellbores, there would be a total of fifty thousand feet (five thousand for each of ten wellbores) of non-producing wellbore that must be drilled and completed, serving little useful purpose. It may, therefore, be desirable to drill as few upper portions as necessary from a single location or site, especially as the cost of the drilling and completing offshore wellbores can range from $100 to $300 per foot of wellbore drilled and completed.

Multilateral well schemes have been proposed since the 1920's. Various methods of constructing these well geometry's have been disclosed showing methods of creating the wellbores, methods of mechanically connecting casings in the various wellbores drilled, methods of sealing the casing junctions, and various methods of providing re-entry access to the lateral wellbores for remedial treatments.

Multilateral wellbore junction construction is currently thought of as fitting into one of six levels of complexity. Level 1 is generally thought of as open hole sidetracks where lateral wellbores are drilled from an open hole (uncased) section of the main well. No casing is present in the main well or lateral well at the junction of the two wellbores. This method is generally the least expensive but does not ensure wellbore stability, does not provide a method of easy lateral re-entry, and it does not seal the junction in a manner to allow future flow control of the lateral versus the main wellbore.

Level 2 multilateral junctions are those where the lateral exits from a cased main well using section miling or whipstock methods to create the exit. The lateral wellbore may be left as open hole or a liner may be run and "dropped off" outside the main well casing exit such that the lateral liner and main casing are not connected and an openhole junction results. This method is currently a little more costly than Level 1; it provides some more assurance of re-entry access to laterals, and it can provide some flow control of the various wellbores. It does not however protect or reinforce the junction area against potential collapse of the open hole wellbore wall.

Level 3 junctions provide laterals exiting from a cased main well and a lateral liner is run in the lateral wellbore and mechanically connected to the main casing but no seal of the junction is achieved. This method supports the borehole created and provides access to laterals but the lack of a seal at the junction can lead to sand production or fluid inflow or outflow into the junction rock strata. In many applications this inflow or outflow of fluids at junction depth is not desirable as the laterals may penetrate strata of different pressures and the unsealed junction could result in an underground blow out.

Level 4 junctions also provide a lateral wellbore exiting from a cased main well and a lateral liner is run into the lateral wellbore with the top end of the lateral casing extending back to the main casing with the junction of the lateral liner and main casing sealed with cement or some other hardening liquid material that can be pumped in place around the junction. This method achieves isolation of the junction from adjoining strata providing a sufficient length annular seal can be placed around the lateral liner and provided the main casing has an annular seal between the casing and the main wellbore wall. Various methods of reentry access to the laterals is provided using deflectors or other devices. The pressure seal integrity achieved in this type of wellbore junction is generally dependent on rock properties of the junction strata and cannot exceed the junction strata fracture pressure by more than a few hundred pounds per square inch. In addition the guaranteed placement and strength of liquid cementatious hardening materials in a downhole environment is extremely difficult with washouts causing slow fluid velocities, debris causing contamination of sealing materials, fluid mixing causing dilution, gelled drilling muds resisting displacement, etc. The junction may be isolated from adjoining zones but seal reliability specifically at the junction is difficult.

Level 5 systems generally provide lateral wellbores exiting from a cased main well. Liners are run in the lateral wellbore and may be "dropped off" outside the window in the main casing or a Level 4 type cemented intersection may be created. The Level 5 systems however use production tubulars and mechanical packer devices to mechanically connect and seal the main casing and lateral liners to each other. Level 5 systems can achieve a junction seal exceeding the junction strata capability by five to ten thousand psi.

These systems do however restrict the diameter of access to the lateral and main casings below the junctions due to the relatively small tubular diameters compared to casing sizes. Well designs must also generally consider the possibility of a leak in the junction tubulars. This limits the application of Level 5 systems to generally those applications where the junction pressures are abnormal for the junction rock only due to surface applied pressures such as may be encountered in injection wells or during well stimulations. Flow rates achievable through such junctions are also restricted to the rates possible through the smaller diameter tubulars.

Level 6 junctions create a mechanically sealed junction between the main casing and lateral liner without using the restricting bores of production tubulars to achieve the seal. The methods devised to date generally are of two categories. One category uses prefabricated junctions in which one or both bores are deformed. This prefabricated piece is lowered into the well bore on a casing string and located in an enlarged or underreamed section of hole such that it can be expanded or unfolded into its original shape/size. The casing string with the prefabricated junction is then cemented in the wellbore. The lateral borehole is then drilled from the lateral stub outlet and a lateral liner is hung/sealed in the lateral stub outlet. A second category of Level 6 junction currently used creates an oversized main well borehole and full size underformed junctions are run into the main wellbore on the main casing. Laterals can then be drilled from a lateral stub outlet as described from the previous category.

FIGS. 1*a* to 1*f* illustrate several conventional methods 200*a* to 200*f* for forming multiple lateral wellbores into reservoirs 202*a* and 202*b*. Multiple lateral wellbores or drainholes 204 are conventionally drilled from the cased main wellbore 208 or from the openhole section 206 of the main wellbore. When constructing the laterals 204*a* from a cased hole 208, a whipstock 214 is usually anchored in main well casing 208 by means of a packer or anchoring mechanism 216. A milling tool (not shown) is deflected by the whipstock face 218 to cut a window 210 in the casing 208. The lateral wellbore 204*a* is then directionally drilled to intersect its targeted reservoir 202*a*. The whipstock face 218 is typically 1 to 6 degrees out of alignment with the longitudinal axis of the whipstock 214 and the lateral wellbore 204*a* is directed away from the main wellbore casing 208 at a substantially equal angle. The intersection or junction between the lateral liner 220 and the main well casing 208 thus created is elliptical in its side view, curved in its cross section, and lengthy due to the shallow angle of departure from the main well casing 208. This conventional prior art method 200*a–d* creates a geometry that is difficult to seal with appreciable mechanical strength or differential pressure resistance. Method 200*e* of FIG. 1*e* uses tubulars and packers to mechanically seal the junction but restricts the final production flow area and access diameters to the two production bores. Method 200*f* of FIG. 1*f* uses a prefabricated junction which is deployed in place in an underreamed or enlarged section of the wellbore. This method requires an enlarged wellbore to the surface or an underreamed portion. If the underreamed wellbore approach is used then current technology deforms the junction piece in the underrearned section and by nature of design uses a low yield strength material which causes low pressure ratings. Alternatively this method may use an oversized diameter main wellbore to allow a prefabricated junction to be placed at the desired depth.

In the conventional multilateral wellbore construction methods described above, the lateral borehole is typically drilled from the main casing and departs the main casing at a shallow angle of 1 to 6 degrees relative to the longitudinal axis of the main casing. Recently, however, multilateral wellbores have been constructed by drilling separate lateral wellbores towards the main well casing, from the outside of the main casing so that the downhole end of the lateral wellbore is located proximate perforations in the main wellbore or even intersecting with the main wellbore if possible. Production fluids such as hydrocarbons can, therefore, be flowed between the main wellbore and the lateral wellbores.

However, such prior methods of constructing multilateral wellbores do not provide a mechanical connection or other suitable seal against downhole pressures between the main wellbore and the lateral wellbores. Accordingly, in a particular application such conventional techniques may only be desirable in situations in which the lateral wellbore intersects a production zone co-extensive with a production zone of the main wellbore. The present invention provides a method of mechanically connecting the lateral liner to the main casing and sealing the junction, which may be beneficial for multilateral wellbore construction where it is desirable to intersect a main wellbore with lateral wellbores drilled from outside the main wellbore in a direction generally towards the main wellbore.

In operations in which high pressure connections are desired, the less desirable conventional drilling techniques described above may heretofore have been employed which require deviating the lateral wellbores from within the main, or parent, wellbore. However, these conventional multilateral wellbore construction techniques may also cause undue casing wear in the parent wellbore when many lateral wellbores are drilled from a common parent well. In such a case, the parent well casing may be exposed to thousands of drillpipe rotations and reciprocations executed in the drilling. This drilling process wears away the metal walls of the casing internal diameter. Drill pipe is also used over and over and is therefore commonly treated with a hard coating on the tool joints to minimize the wear on the drill pipe itself. This wear resistant coating on the drill pipe can increase the wear on the casing. Since the production of the wellbore typically flows through the parent wellbore to the surface, the parent casing typically must have sufficient strength after drilling wear to contain wellbore pressures while also accounting for corrosion and erosion expected during the production phase of the well. Accordingly, a need has arisen to provide mechanical connection methods and apparatus between lateral wellbores and parent wellbores for operations in which it may be beneficial to drill the lateral wellbores from outside the parent wellbore in a direction towards the parent wellbore.

Further, during the completion of a wellbore, a number of devices are utilized in the wellbore to perform specific functions or operations. Such devices may include packers, sliding sleeves, perforating guns, fluid flow control devices, and a number of sensors. To efficiently produce hydrocarbons from wellbores drilled from a single location or from multilateral wellbores, various remotely actuated devices can be installed to control fluid flow from various subterranean zones. Some operators are now permanently installing a variety of devices and sensors in the wellbores. Some of these devices, such as sleeves, can be remotely controlled to control the fluid flow from the producing zones into the wellbore. The sensors are used to periodically provide information about formation parameters, condition of the wellbore, fluid properties, etc. Until now the flow control devices and sensors have been installed in the main well production tubing necessitating a reduction in the production flow area for a given main casing size. For example devices are now available matching 5½ inch nominal tubing to fit in 9⅝ inch nominal casing. 7 inch nominal tubing could be used in 9⅝ inch casing but the remotely operated production control devices are restricted to 5½. The present invention provides a method of placing the production control devices out of the main casing and into the lateral wellbore so they do not restrict the main casing tubular design or size and yet production of each lateral wellbore is controlled independently.

In deepwater fields (generally oil and gas fields lying below ocean water depths greater than 1000 ft), the costs of field development are even more extreme than the costs previously mentioned. In these environments satellite wells might be used with seafloor flowlines connected back to a central seafloor manifold for processing and a flowline extends from the central manifold to the sea surface where it is connected to a floating vessel or from the central manifold along the seafloor to a nearby existing platform or pipeline infrastructure. In these deepwater applications the reservoir fluids are subjected to cold ocean floor temperatures (which are generally 40 degrees Fahrenheit or less). These cold temperatures can cause problems in flow assurance since many hydrocarbons contain waxes which will crystallize when the fluid is cooled and can plug pipelines or flowlines especially if flow is stopped for any reason. The typical solution is to insulate individual wellbore risers from the seafloor to the sea surface and/or to insulate flowlines on the seafloor or even make provisions for flowline heating. These solutions have an associated high cost. The present invention provides for connecting wellbores at reservoir depth such that the wellbore fluids remain at substantially reservoir temperatures and pressures until they reach a common outflow wellbore to the surface thus addressing a portion of the well flow assurance concerns.

Accordingly, there is a need for a method and apparatus for providing mechanical connections between a main wellbore and a lateral wellbore, in which the lateral wellbore has been drilled from outside the main wellbore in a direction generally towards the main wellbore. The present invention provides a method and apparatus for providing mechanical connections between a main wellbore and a lateral wellbore, in which the lateral wellbore has been drilled from outside the main wellbore in a direction generally towards the main wellbore In addition, there is a need for measurement and control apparatus in the lateral wellbores so that production through the lateral wellbores can be controlled independent of the production through the main wellbore. The present invention provides measurement and control apparatus in the lateral wellbores so that production through the lateral wellbores can be controlled independent of the production through the main wellbore.

SUMMARY OF THE INVENTION

In a particular aspect, the present invention is directed to downhole well system including a main wellbore and a lateral wellbore, wherein the lateral wellbore is drilled from outside the main wellbore in a direction generally towards the main wellbore, a wellbore junction, comprising: a mechanical seal between the lateral wellbore and the main wellbore.

A feature of this aspect of the invention is that the main wellbore may include a lateral receiver coupling, and wherein a fluid sealant such as cement has been pumped through the lateral wellbore and hardened to mechanically seal the lateral wellbore within the lateral receiver coupling.

Another feature of this aspect of the invention is that the fluid sealant may be pumped through a cementing port collar disposed within the lateral wellbore. The main wellbore may include a lateral receiver coupling, wherein the lateral wellbore includes a mechanical latching mechanism adapted to engage with the lateral receiver coupling of the main wellbore. The mechanical latching mechanism may be spring-actuated; and the spring-actuated latching mechanism may include at least one locking dog adapted to mate with a latch profile within the lateral receiver coupling.

Yet another feature of this aspect of the invention is that the mechanical latching mechanism may comprises: a plurality of tapered keys spaced apart and disposed about an outer surface of the lateral liner; and a plurality of tapered keys spaced apart and disposed about an inside surface of the lateral receiver coupling, whereby a keyway is provided between each of the plurality of tapered keys, and whereby rotation of the lateral liner causes the keys of the lateral liner to engage with the keys of the lateral receiver coupling to urge the lateral liner against a sealing surface associated with the lateral receiver coupling.

In another aspect, the present invention is directed to a latching system for mechanically interconnecting a lateral wellbore with a main wellbore, comprising: a lateral receiver coupling associated with the main wellbore; and a mechanical latching mechanism associated with the lateral wellbore. A feature of this aspect of the present invention is that the lateral receiver coupling may be adapted to receive a portion of the lateral wellbore therein. The lateral wellbore liner may also include the mechanical latching mechanism on its distal end proximate the main wellbore; and the lateral receiver coupling may also be an axial receiver coupling for joining two axially oriented wellbores.

Another feature of this aspect of the invention is that the lateral receiver coupling may include a receiving bore for receiving a lateral liner of the lateral wellbore. The receiving bore may extend from the main wellbore at an angle substantially 90 degrees from the long axis of the main wellbore, the receiving bore may extend from the main wellbore at an angle generally towards the wellhead, or the receiving bore may extend from the main wellbore at an angle generally away from the wellhead.

In yet another aspect, the present invention is directed to a method of forming a plurality of interconnected wellbores for producing hydrocarbons from or injecting fluids into earth formations comprising the steps of: forming a parent wellbore with a parent wellbore casing with one or more lateral wellbore receiver couplings placed in its casing; forming a lateral wellbore with a lateral wellbore liner to intersect the parent wellbore casing proximate the lateral wellbore receiver coupling; and mechanically connecting the lateral wellbore liner to the parent wellbore casing.

A feature of this aspect of the invention is that the step of forming the lateral wellbore to intersect the parent wellbore casing proximate the lateral wellbore receiver coupling may further compirse the steps of: providing a beacon within proximate the receiver coupling to emit signals adapted to be received by a sensor in a lateral wellbore drilling assembly; and steering the drilling assembly towards the lateral wellbore receiver coupling in response to the signals emitted by the beacon and received by the sensor in the drilling assembly.

Another feature of this aspect of the invention is that the signal emitted by the beacon may be of a type selected from the group consisting of acoustic, electromagnetic, or thermographic signals. The main wellbore may be formed in an oilfield having at least one existing wellbore and the method may further comprise the steps of establishing fluid communication between one or more of the existing wellbores and the main wellbore.

Yet another feature of this aspect of the invention is that the method may further comprise a step of underreaming the end of the lateral wellbore adjacent the receiver coupling to allow lateral movement and flexibility of the lateral liner for minor alignment adjustments in the mating of the lateral liner to the receiver coupling.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

FIG. 2 is a perspective view of a main wellbore according to a first embodiment of the present invention wherein the intersection to be formed is perpendiculars FIG. 3*a* is a cross-sectional view of the main wellbore of FIG. 2 showing a drilling assembly being guided by guidance beacons to intersect with a lateral receiver coupling according to an embodiment of the present invention.

FIG. 4 is a cross-sectional view of an embodiment of a wellbore intersection according to the present invention wherein the intersection of the two wellbores is axial.

FIG. 5 is a cross-sectional view of the intersected and connected liners of the main wellbore and lateral wellbore according to the embodiment shown in FIG. 2.

FIG. 10 is a cross-sectional view of a latching mechanism according to a second embodiment of the present invention.

FIG. 11 is a projected plan view of the keys and keyways of the latching mechanism of FIG. 10.

DETAILED DESCRIPTION OF THE PREFERRED EMBODIMENT

Figure 1A:
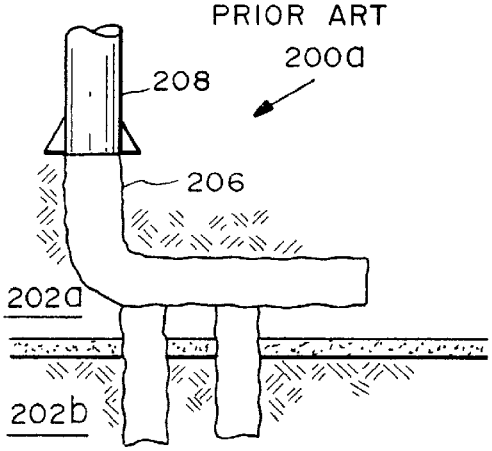
FIG. 1A PRIOR ART
FIGS. 1*a*–1*f* illustrate conventional methods of constructing multilateral wellbore junctions.
Figure 1B:
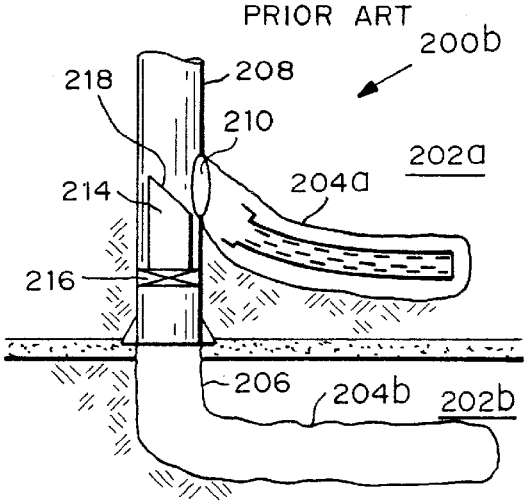
FIG. 1B PRIOR ART
Figure 1C:
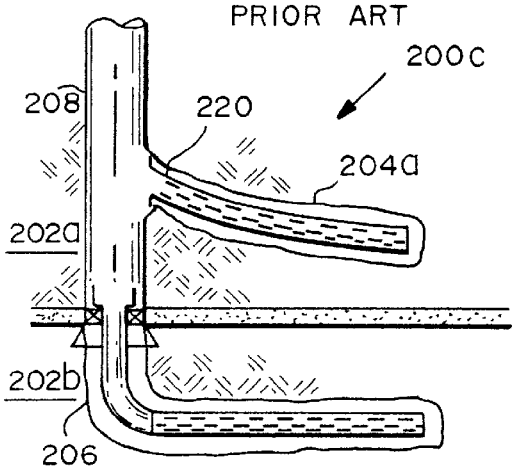
FIG. 1C PRIOR ART
Figure 1D:
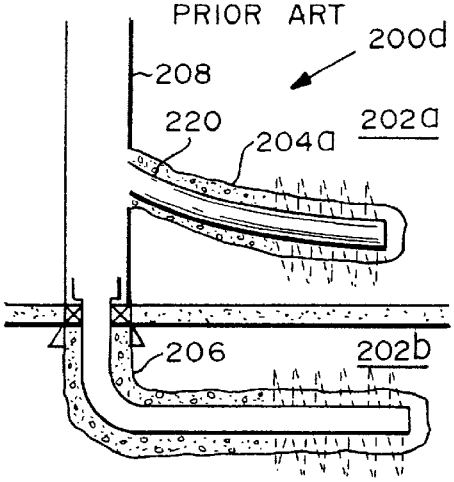
FIG. 1D PRIOR ART
Figure 1E:
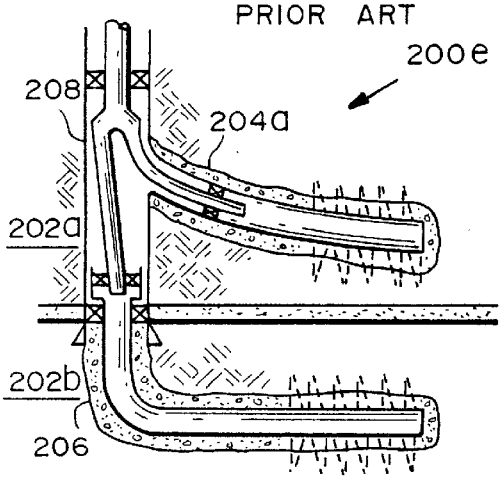
FIG. 1E PRIOR ART
Figure 1F:
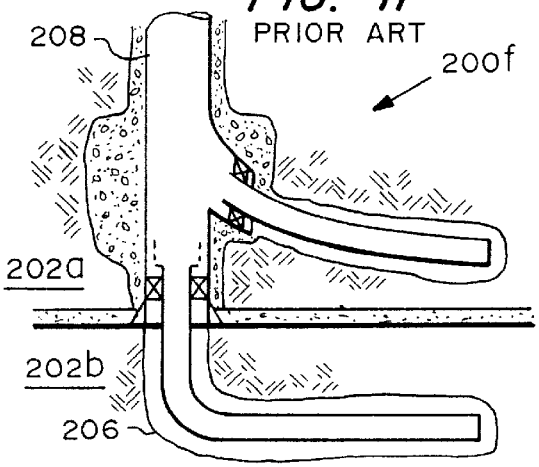
FIG. 1F PRIOR ART

The present invention generally provides a method and apparatus for interconnecting multilateral wellbores with a main, or parent, wellbore whereby the lateral wellbores are drilled from outside the main wellbore in a direction generally towards the main wellbore. A wellbore junction according to the present invention is generally provided by a lateral receiver coupling 22 engaged by mechanical connection with a lateral liner 50, as described further hereinbelow.

Referring to FIG. 2, a perspective view of a main wellbore casing 32 is shown having lateral receiver coupling 22 connected to or otherwise disposed in connection with the outer surface thereof. The main wellbore casing 32 is adapted to be lowered or otherwise provided in a main, or parent wellbore using conventional casing methods known in the art. A plurality of guidance beacons 34 are placed at multiple positions along the lateral receiver coupling 22 or on the adjoining main well casing 32 and are known distances from the centerline 37 of the connecting lateral bore opening 36 formed by the walls of lateral receiver coupling 22.

Referring now to FIG. 3*a*, main wellbore casing 32 is shown in partial cross-section lowered in place within a main, or parent, wellbore 18. It should be noted that the main wellbore may be vertical, horizontal, or have any other orientation in a particular application. In addition, the main wellbore may have separate sections which may be independently vertical, horizontal, or some other orientation relative to the surface. The main, or parent, wellbore may typically be a primary production wellbore; however, to the extent consistent herewith, the terms "main wellbore" or "parent wellbore" herein refer to any wellbore to which it may be desired to remotely couple a separate wellbore drilled from a location outside the main wellbore towards the main wellbore after the main wellbore is already in place. To the extent the context herein does not indicate anything to the contrary, the term "wellbore" herein refers to a conduit drilled through a particular geological formation and may also refer to the drilled conduit including well casing, tubing, or other members therein. The term "lateral wellbore" refers generally to the separate wellbore being drilled towards and intended to connect with the main wellbore.

Still with reference to FIG. 3*a*, wellbore casing 32 includes lateral receiver coupling 22 disposed in connection therewith. A conventional guidance system known in the art such as guidance beacons 34 are shown in connection with the casing 32 and preferably send signals into the surrounding strata. Preferably, a plurality of guidance beacons 34 are provided on the well casing 32 and are spaced-apart from centerline 37, which passes through the center of receiving bore 36. A separate guidance beacon 34 may also be preferably provided on a receiving bore cap 35 initially connected to the lateral receiving coupling 22. It should be noted that the guidance system described herein is illustrative only and that other guidance systems as may be known in the art may also be employed.

Still with reference to FIG. 3*a*, lateral borehole 44 is shown being drilled by bit 38 provided at the end of a drilling string. Bit 38 is steered by conventional directional steering tools known in the art such as directional steering tool 41. In the directional steering tool 41 shown, the path of the drilling bit 38 is adjusted as conventional guidance sensors 40 detect and interpret the current borehole location relative to the centerline 37 of receiving bore 36. Receiving bore 36 is in a known spatial relationship relative to the guidance beacons 34. Preferably, a rotary steerable drilling assembly such as the "Autotrak" drilling assembly available from Baker Oil Tools or other suitable steering drill assembly may be modified to have an added guidance sensor 40 to detect the source location of guidance beacons 34.

Figure 3B:
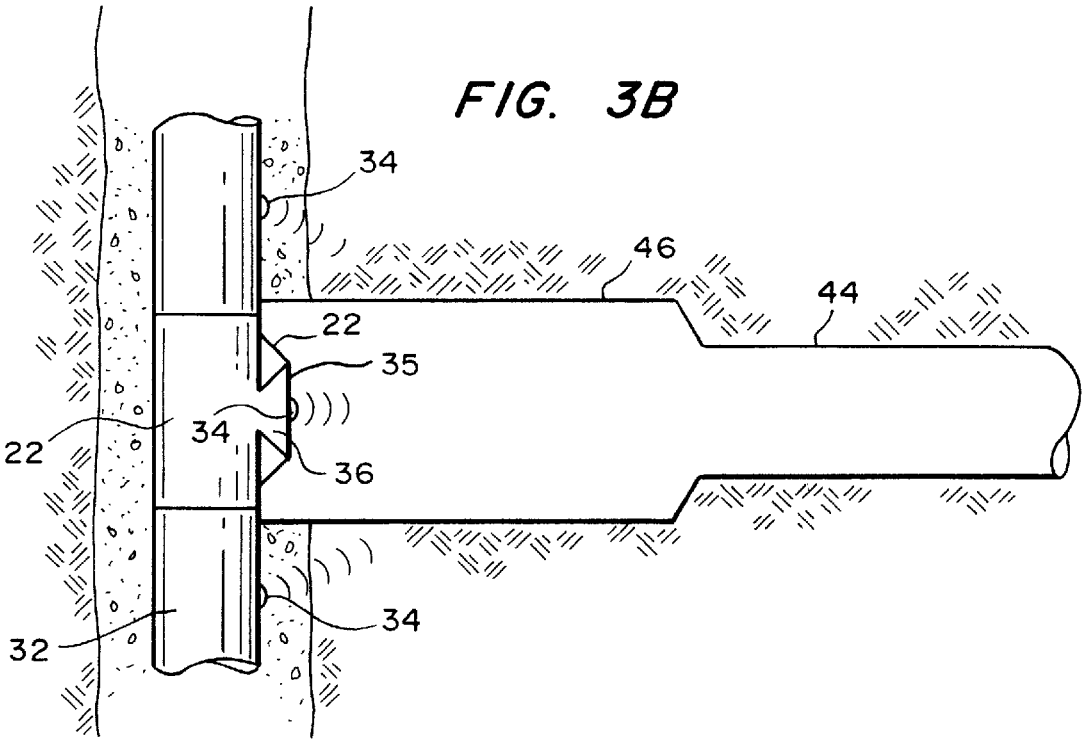
FIG. 3*b* is a cross-sectional view of the main wellbore of FIG. 2 showing the lateral wellbore drilled according to the embodiment of FIG. 3*a*, and also showing an under-reamed portion of the wellbore proximate the lateral receiver coupling according to an embodiment of the present invention.

Referring now to FIG. 3*b*, the lateral borehole 44 has preferably been drilled so that the centerline of the lateral receiver coupling 22 and the centerline of the lateral borehole 44 are generally co-extensive. An under-reamed section 46 of borehole 44 is created as shown proximate lateral receiver coupling 22 using conventional drilling techniques. Although not shown, a conventional running tool may be run through the lateral borehole 44 and used to remove the cover 35 from the lateral receiver coupling 22 so that a lateral liner may be inserted within the receiving bore 36 of the lateral receiver coupling 22 as described further below.

Hardenable Fluid Sealant Embodiment

Figure 3C:
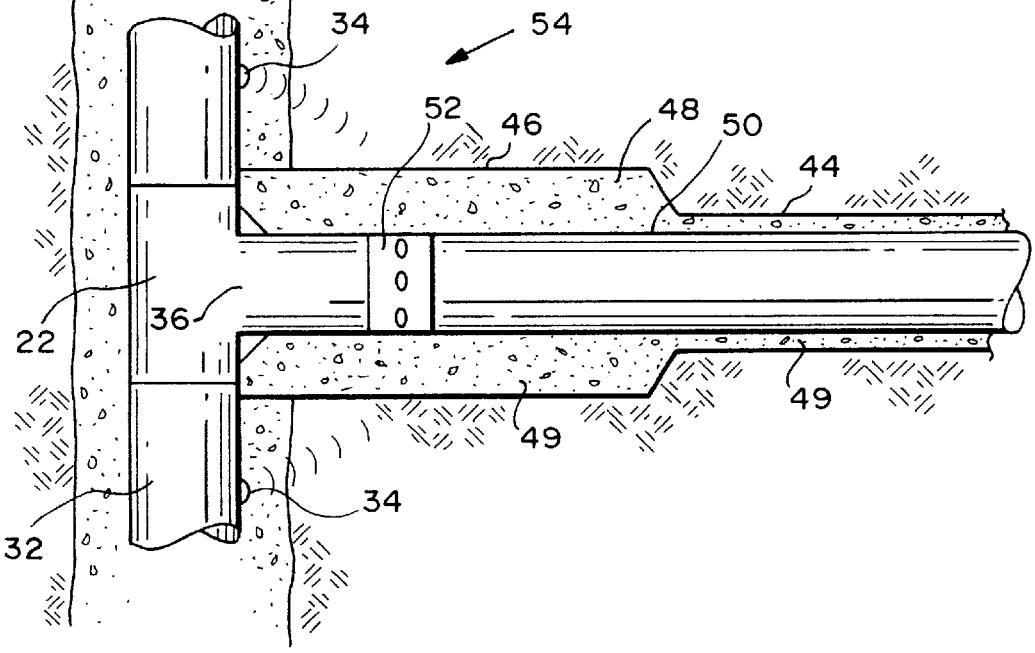
FIG. 3*c* is a cross-sectional view of the main wellbore of FIG. 2 showing a lateral liner run into the lateral borehole of FIG. 3*b* and coupled to the lateral receiver coupling of the main wellbore of FIG. 2.

Referring now to FIG. 3*c*, lateral liner 50, which may be wellbore casing or some other suitable tubular assembly, has been run into the lateral borehole 44 using conventional techniques and is inserted into the receiving bore 36 of lateral receiver coupling 22. A stage tool or cementing port collar 52 may be provided within lateral liner 50 proximate the end of the lateral liner 50 inserted into the receiving bore 36 of lateral receiver coupling 22. A hardenable liquid sealant or cement 48 may then be pumped through the lateral liner 50, through cementing port collar or stage tool 52, and into annulus 49 formed defined by the under-reamed section 46. The stage tool or port collar 52 may then be closed, thus creating in one embodiment a mechanical seal between the lateral liner 50 and the lateral receiver coupling 22 and, accordingly, the main wellbore casing 32 to which the lateral receiver coupling 22 is connected. It should be noted that, in this embodiment, essentially no sealing mechanism or sealing substance is provided within the production bore of either the lateral liner 50 or the main wellbore casing 32 so that flow therethrough is not significantly impeded. It should further be noted that this embodiment may be used as a primary mechanical seal or it may be used in connection with the latching mechanism embodiments described below.

Referring to FIGS. 2–3, 5, and 12, the lateral receiver coupling 22 is shown having a receiving bore 36 extending generally 90 degrees to direction of the main wellbore casing 32 to form a "T" intersection. However, the receiving bore 36 of lateral receiver coupling 22 may also extend at any desired angle relative to the main wellbore casing 32. Referring to FIG. 4, it will be readily apparent that receiver coupling 24 may also be an axial receiver coupling 24 provided axially at a distal end of the main wellbore casing 32 to form an "end-to-end" intersection. In this embodiment, guidance beacons 34 may preferably be spaced apart and on opposing sidewalls of axial lateral receiver coupling 24.

Lateral Connector

Referring now to FIG. 5, lateral liner 50 is shown intersecting with and connected to lateral receiving coupling 22. Lateral liner 50 may include lateral connector 62, which may be attached to the distal end 66 of the lateral liner 50 to be connected to the lateral receiver coupling 22 of the main wellbore casing 32. The lateral connector 62 generally comprises: seal bore receptacle 76, equipment receptacle 74, and latch mechanism 56. Seal bore receptacle 76 is preferably threadedly attached to the distal end 66 of the lateral liner 50 and receptacle 76 preferably has a polished seal bore surface 80 suitable for mating with a sealing member (not shown). Equipment receptacle 74 is preferably threadedly attached to the opposite end of the seal bore receptacle 76.

Figure 6:
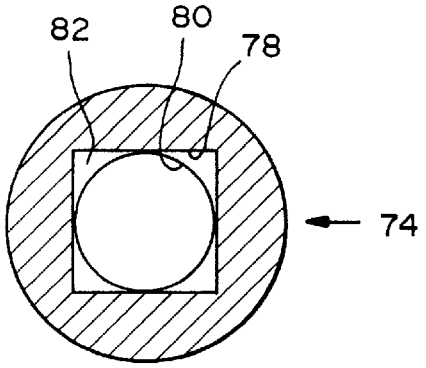
FIG. 6 is a cross-sectional view of a portion of the lateral liner of FIG. 5, taken along section 6—6.

A cylindrical wall of equipment receptacle 74 preferably defines bore 78 therewithin. Referring now to FIG. 6, equipment receptacle 74 is shown in a cross-section taken along section 6—6 of FIG. 5. As shown in FIG. 6, the cross-section of bore 78 of equipment receptacle 74 may preferably be square (shown in FIG. 6). It should be noted, however, that the cross-section of bore 78 of equipment receptacle 74 may also be cylindrical (not shown) or have some other suitable cross-section. In the preferred embodiment, the cross-section of bore 78 is rectangular.

In the event that the cross-section of bore 78 is rectangular, transitional cross-sectional areas may be required to suitably mate with the preferably cylindrical cross-sectional area of seal bore 80 of seal bore receptacle 76. Accordingly, surface 82 may preferably be spherical or conical to provide the transition from the preferably square equipment receptacle bore 78 to the preferably cylindrical seal bore 80.

Figure 7:
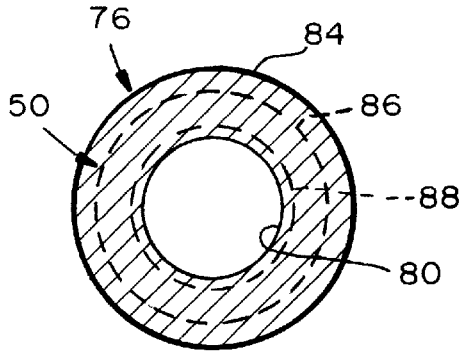
FIG. 7 is a cross-sectional view of a portion of the lateral liner of FIG. 5, taken along section 7—7.

Referring now to FIG. 7, seal bore receptacle 76 is shown in a cross-sectional view taken along section 7—7 of FIG. 5. The preferred diameter of seal bore receptacle 76 defining seal bore surface 80 is shown relative to the internal diameter of the bore 88 of the lateral liner 50 and also relative to the outer diameter of the outside surface 86 of lateral liner 50. Referring again to FIG. 5, latch mechanism 56 is shown threadedly attached to the end of the equipment receptacle 74.

Latch mechanism 56 will be described in more detail below with reference to FIGS. 9, 10 and 11.

Equipment Assembly

Figure 8:
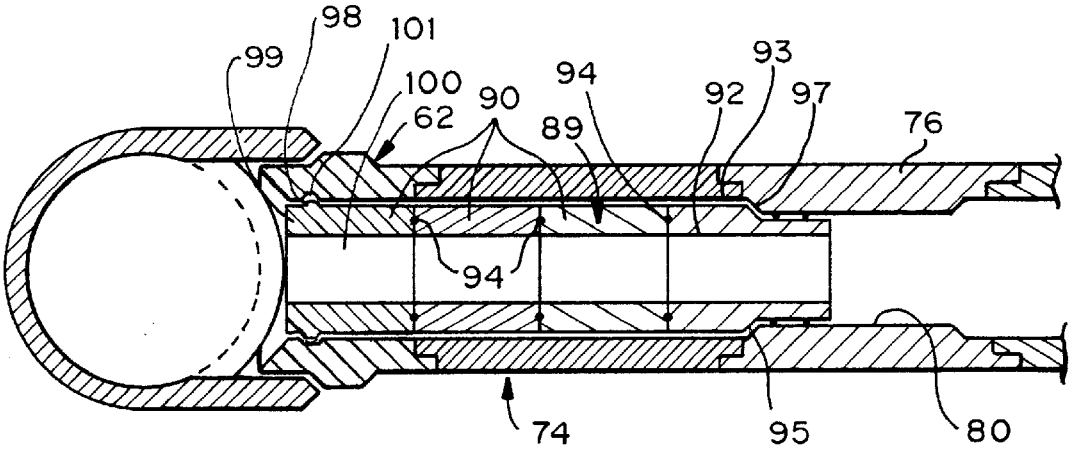
FIG. 8 is a cross-sectional view of the intersected and connected liners of a main wellbore and a lateral wellbore according to the embodiment of FIG. 2 with flow controls and other equipment installed.

Referring now to FIG. 8, lateral connector 62 is shown having equipment assembly 89 disposed within equipment receptacle 74. Equipment assembly 89 comprises seal assembly 92, which has a proximal end adapted to sealingly engage seal bore surface 80 to create a hydraulic pressure retaining seal between the outside diameter of the seal assembly 92 and the inside diameter of the seal bore receptacle 76. A portion of seal assembly 92 preferably has an enlarged outside diameter 93 defining shoulder 95. Shoulder 95 is adapted to bear on landing 97 associated with equipment receptacle 74 to limit the movement of the seal assembly 92 beyond a given point in the seal bore 76.

A face seal 94 is preferably located on the distal end of the seal assembly 92. A sealing force may be applied to an adjoining equipment module 90 against seal assembly 92, whereby the face seal 94 will create a pressure seal between the equipment module 90 and the seal assembly 92. A plurality of equipment modules 90 may be similarly joined with face seals 94 provided between each set of adjoining module 90. Each of the equipment modules 90, the seal assembly 92, and the latch module 99 include a flow through bore 100. Equipment modules 90 may preferably include conventional monitoring or control modules, providing, for example: a) well flow control devices (having choked positions or full open or full closed positions); b) monitoring devices for sensing wellbore parameters such as water cut, gas/oil ratios, fluid composition, temperature, pressure, solids content, clay content, or tracer/marker identification; c) a fuel cell, battery, or power generation device; or d) a pumping device.

The last module 90 to be inserted into the equipment receptacle 74 proximate the distal end of the lateral liner 50 is preferably latch module 99. Latch module 99 preferably includes a face seal 94 to seal it to the adjoining equipment module 90, and also preferably includes a conventional latch mechanism 98 adapted to retain the latch module 99 within the equipment receptacle 74 by engaging a recessed profile 101 within the lateral liner 50.

First Latching Mechanism Embodiment

Figure 9C:
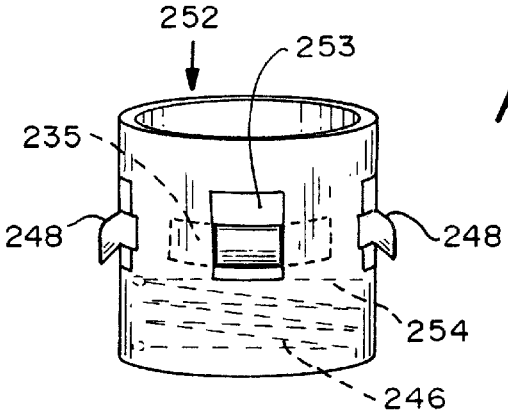
FIG. 9*c* is a side view of the locking dog within the sleeve of the latching mechanism of FIG. 9*a* and also showing the spring and push ring thereof.
Figure 9B:
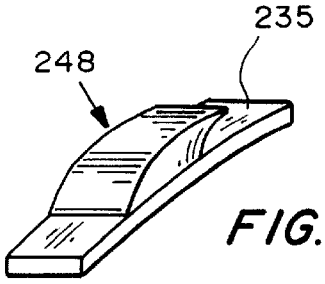
FIG. 9*b* is a perspective view of a locking dog of the latching mechanism of FIG. 9*a* according to an embodiment of the present invention.
Figure 9A:
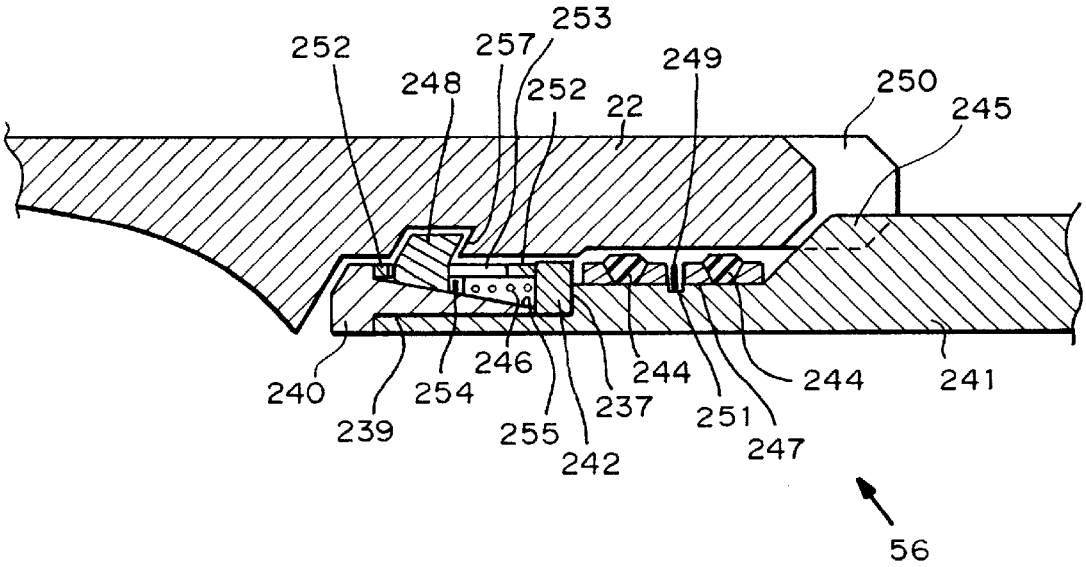
FIG. 9*a* is a cross-sectional view of a latching mechanism according to a first embodiment of the present invention.

Referring now to FIG. 9*a*, a first embodiment of latching mechanism 56 is shown in detail. Main mandrel 241 of latch mechanism 56 is preferably threadedly attached to the equipment receptacle 76 (shown in FIG. 5) as previously described. A plurality of seals 244 may be mounted on an outer seal surface 247 of main mandrel 241. A snap ring 249 is preferably installed in groove 251 to hold the seals in place about the main mandrel 241. Stop nut 242 preferably has a threaded inner surface and is preferably screwed onto a threaded portion of mandrel 241 until it reaches stop shoulder 237. Sleeve 252 is preferably provided about the main mandrel 241 proximate the distal end of main mandrel 241. End cap 240, is threadedly attached to the main mandrel to provide a tapered, conical, surface 255 between the main mandrel 241 and the sleeve 252.

A plurality of locking dogs 248, preferably having wings 235 extending therefrom (as shown in FIG. 9*b*), are provided within sleeve 252 and have a portion thereof which are adapted to selectively extend through slots 253 provided in sleeve 252 (as shown in FIG. 9*c*). Locking dogs 248 are adapted and positioned to partially extend through slots 253 as they slide along tapered surface 255 of end cap 240. Locking dogs 248 are further adapted to include a latching portion adapted to protrude past the outside diameter of a sleeve 252. Locking dogs 248 are retained within sleeve 252 by wings 235 (shown in FIG. 9*b* and 9*c*) which engage the inner surface of sleeve 252.

Push ring 254 is provided between the end cap 240 and sleeve 252 to press uniformly on the ends of the locking dogs 248 as spring 246 inserted behind the push ring 254 biases push ring 254 away from stop nut 242. The slots 253 allow the locking dogs 248 to slide axially along the tapered surface 255 of end cap 240. As the latching mechanism 56 is inserted into the lateral receiver coupling 22, the latching dogs slide backward against spring 246 or other biasing member and inward toward the smaller diameter of conical surface 255. When the latching mechanism 56 reaches the full insertion depth into the lateral receiver coupling 22, the latch dogs 248 mate with a latch profile within the lateral receiver coupling 22 and are pushed up the conical surface 255 by spring 246 such that they protrude into the latch profile and engage bearing shoulder 257.

Accordingly, a spring-actuated latching mechanism 56 is provided to automatically engage the lateral liner 50 within the lateral receiver coupling as the lateral liner 50 is inserted into the lateral receiver coupling 22.

To ensure alignment of the locking dogs 248 and the mating latch profile as the latching mechanism 56 is inserted into the lateral receiver coupling 22, key 245 may be machined into the outer surface of the main mandrel 241 and adapted to engage a matching keyway 250 provided in the lateral receiver coupling 22 to index the rotational position of the lateral connector 62 relative to the receiver coupling 22. Seals 244 may be elastomeric interference fit, or chevron shaped non-elastomeric interference fit, or non-elastomeric spring metal energized or expandable metal or shape memory alloy or lens ring crush seals or other suitable seal design and material.

Second Latching Mechanism Embodiment

With reference now to FIGS. 10 and 11, a second embodiment of latching mechanism 56 is shown intersecting lateral receiver coupling 22. In this embodiment, at least one seal 244 is mounted onto the main mandrel 24 Ion a surface 263. A plurality of seals 244 may be separated and held in position by a snap ring 249 positioned in a groove 267. A stop shoulder 268 retains seals 244 on main mandrel 241. In this embodiment, a plurality of keys 260 are preferably machined onto the outer surface of main mandrel 241. Keys 260 preferably have a flat lower face 261 facing the distal end of the main mandrel 241 and also facing lateral receiver coupling 22. Keys 260 preferably further include an angled upper face 259 facing the running length of the lateral liner 50. A plurality of opposing keys 273 are preferably machined onto the inner surface of lateral receiver coupling 22.

Referring now to FIG. 11, a set of keys 273 of lateral receiver coupling 22 and the keys 260 of main mandrel 241 are shown in a flat projection to illustrates the relationship of the various keys and keyways. The keys 273 are machined into the lateral receiver coupling 22 to create a set of keyways 269 therebetween. The keys 260 of main mandrel 241 are adapted to fit through the keyways 269 of the lateral receiver coupling 22 as main mandrel 241 is inserted within the lateral receiver coupling 22. In particular, a set of latch keys 271 includes a plurality of narrow keys 260*a* and a wide key 260*b*. The narrow keys 260*a* fit through a mating plurality of narrow keyways 269*a* and the wide key 260*b* must pass through a wide keyway 269*b*. When the latch mandrel 241 is inserted into the coupling 22, the set of latch keys 271 follows the path of arrow y and pass beyond the plurality of latch keys 273. Thereafter, main mandrel 241 is rotated clockwise in the direction of arrow x so that angled faces 259 engage angled faces 275 interlocking the lateral connector 62 with the lateral receiver coupling 22. Due to the singular wide key 260*b* there is only one orientation in which the two parts will engage. As the lateral connector is rotated clockwise the angled faces 259 and 275 bear against one another creating an axial movement of the connector 62 into the coupling 22. Referring again to FIG. 10, a nose seal 258 is preferably machined into the end of the mandrel 266 with a gap 256 ensuring that the nose seal 258 has suitable flexibility to sealingly engage a seal face 270 as the angled faces 259 and 275 move the seal mandrel 266 into the coupling 22. Stop shoulder 272 prevents the rotational over travel of the keys to rotationally index the connector 62 and coupling 22 and to prevent improper deformation of the nose seal 258.

Figure 12:
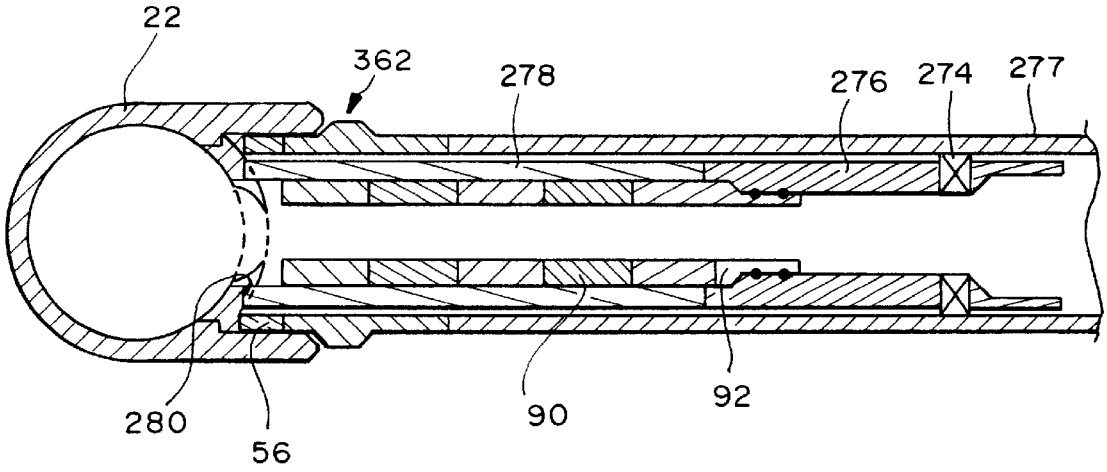
FIG. 12 is a cross-sectional view of the intersected and connected liners of a main wellbore and a lateral wellbore according to a third embodiment of the present invention.

FIG. 12 shows a cross section of an alternative embodiment of the receiver coupling 22 and a lateral connector 362. In this embodiment the lateral connector 362 need not be rotationally indexed with the coupling 22 since the connector 362 in this case only consists of a latch mechanism 56 connected directly to the lateral liner 277. A seal bore 276 and an equipment receptacle 278 are in this case suspended below a packer 274 which is set in lateral liner 277 to anchor these devices in the lateral liner. An indexing member 280 engages a mating profile in the coupling 22 before the packer 274 is set. The indexing member may be a clutch mechanism as described relative to FIG. 9 or it may be a spring loaded key which finds a mating recess in coupling 22 or other such devices known to those skilled in the art. The full bore of liner 277 is available for operations in the lateral liner in this embodiment until the assembly comprising items 278, 280, 274, and 276 is inserted. This inserted assembly may also be retrievable through lateral liner 277 or permanently installed.

In operation, a main vertical wellbore 18 may be drilled through which production fluids are desired to be pumped or otherwise recovered to the surface. Thereafter, a production string of main wellbore casing, including lateral receiver coupling is inserted within the main vertical wellbore. A lateral wellbore, which may be horizontal or have some other orientation, is drilled from a location outside of the main wellbore casing in a direction generally towards the lateral receiver coupling until the lateral wellbore interconnects with the main wellbore. Thereafter, lateral liner having a latching mechanism according to the present invention connected to the distal end thereof is inserted within the lateral wellbore until it reaches the lateral receiver coupling. The lateral liner is then inserted further within the lateral receiver coupling until the latching mechanism engages within the lateral receiver coupling. In a first embodiment, the latching mechanism is automatically engaged with the lateral receiver coupling as the locking dogs reach the matching profile within the lateral receiver coupling. In the second embodiment, the latching mechanism is engaged with the lateral receiver coupling by rotating the lateral liner and thereby rotating the locking mechanism until the tapered keys associated with the lateral liner engage with the matched tapered keys associated with the lateral receiver coupling.

After the lateral wellbore has been connected to the main, substantially vertical wellbore, the lateral wellbore may be referred to as the main wellbore. Consequently, this new main wellbore may include axial receiver couplings to interconnect successive lengths of lateral liners 50 and/or include lateral receiver couplings to receive locking mechanisms of other lateral wellbores. Accordingly, a wide variety of downbole manifold systems may be contemplated using the method and apparatus of the present invention. By incorporating measurement and flow control devices within the lateral wellbores, each of the lateral wellbores can be independently monitored and/or controlled to have complete control of the downhole manifold system. Accordingly, since there may be redundant pathways to the surface through multiple lateral wellbores, the production of all feeder laterals need not be halted to service the main wellbore. Only the wellbores between the bore to be used for servicing and the target wellbore to be serviced need be remotely closed. Flow of other wellbores may be diverted to the alternate main wellbore until servicing operations are complete. Servicing robots may contain "equipment cars" alternated with "push/pull cars". The equipment cars carry items such as the seal assembly 92, the modules 90, or the latch modules 98 and the pushlpull devices may move the equipment between the cars and the lateral connector equipment receptacles 74. The robot "train" may also include "cars" containing repair modules, inspection modules, testing modules, data downloading modules, or device activation modules.

Service work on the feeder wellbores can also be performed through the wellbore from which the feeder wellbores were drilled to allow more extended access or more complete workover/treatment capability without risking operations in the main wellbore.

While the foregoing is directed to the preferred embodiment of the present invention, other and further embodiments of the invention may be devised without departing from the basis scope thereof. For example, the mechanical connection between the lateral receiver coupling and the lateral connector may be achieved by threading the two mating parts and screwing them together downhole, or they may be joined by expanding or swaging the end of the lateral connector inside the receiver coupling, or by a collet on the connector snapped into a groove in the coupling with a sleeve shifted behind the collet to lock it in place, or other such connection methods as are known in the art. Further, the guidance beacons 34 on the lateral receiver coupling 22 may also be sensors receiving signals generated by a drilling tool. The location data collected by these sensors may then be used to guide the corresponding drilling assembly to the desired intersection point. The beacons or sensors may be permanently mounted on the main casing or they may be retrievably located in the main casing in known spatial relationship to the receiver coupling. Accordingly, the scope of the present invention is determined only by the claims that follow.

What is claimed is:

1. In an oilfield downhole well system comprising a main wellbore and at least one secondary wellbore:

a wellbore casing provided in said main wellbore;

at least one lateral receiver coupling mounted in said wellbore casing, said lateral receiver coupling having a receiver bore in fluid communication with said main wellbore and providing an opening through the casing wall;

a lateral wellbore liner provided in said secondary wellbore and extending into a fluid reservoir and laterally towards said main wellbore and such that said lateral wellbore liner intersects with said main wellbore proximate said lateral receiver coupling, said wellbore liner adapted to provide fluid communication with said fluid reservoir;

junction means connecting said lateral wellbore liner and the lateral receiver coupling which is proximate thereto in fluid communication with one another;

means establishing a seal for the connection of said lateral wellbore liner and the lateral receiver coupling proximate thereto such that the main wellbore casing and said lateral wellbore liner are in fluid communication with each other and with said reservoir;

the lateral wellbore liner includes a mechanical latching mechanism adapted to engage with the lateral receiver coupling of the main wellbore, said mechanical latching mechanism comprising:

a first set of a plurality of tapered keys spaced apart and disposed about an outer surface of the lateral wellbore liner, and a second set of a plurality of tapered keys spaced apart and disposed about an inner surface of the lateral receiver coupling whereby a keyway is provided between each of the plurality of tapered keys in said second set and the next key adjacent thereto in said second set whereby the lateral liner may be inserted into the receiver bore of said lateral receiver coupling and whereby rotation of the lateral wellbore liner causes the keys of the lateral wellbore liner to engage with the keys of the lateral receiver coupling to urge the lateral wellbore liner against a sealing surface associated with the lateral receiver coupling.

2. The downhole well system of claim 1 wherein the lateral receiver coupling is an axial receiver coupling for joining two axially oriented wellbores.

3. The downhole well system of claim 2 wherein the receiver bore of said lateral receiver coupling extends from the main wellbore at an angle substantially 90° from the long axis of the main wellbore.

4. In an oilfield downhole well system comprising a main wellbore and at least one secondary wellbore:

a wellbore casing provided in said main wellbore;

at least one lateral receiver coupling mounted in said wellbore casing, said lateral receiver coupling having a receiver bore in fluid communication with said main wellbore and providing an opening through the casing wall;

a lateral wellbore liner provided in said secondary wellbore and extending into a fluid reservoir and laterally towards said main wellbore and such that lateral wellbore liner intersects with said main wellbore proximate said lateral receiver coupling, said wellbore liner adapted to provide fluid communication with said fluid reservoir;

junction means connecting said lateral wellbore liner and the lateral receiver coupling which is proximate thereto in fluid communication with one another;

means establishing a seal for the connection of said lateral wellbore liner and the lateral receiver coupling proximate thereto such that the main wellbore casing and said lateral wellbore liner are in fluid communication with each other and with said reservoir, said downhole well system further comprising an equipment receptacle, a packer, and an indexing member inserted through said lateral wellbore liner and indexed to the lateral receiver coupling prorate thereto and anchored in place by setting of the packer.

5. The downhole well system of claim 4 wherein the packer, equipment receptacle, and indexing member are permanently installed in said lateral wellbore liner.

6. The downhole well system of claim 4 wherein the packer equipment and indexing member are retrievably installed in said lateral wellbore liner.

7. A method of forming a plurality of interconnected wellbores for producing hydrocarbons from or injecting fluids into earth formations comprising the steps of:

forming a parent wellbore with a parent wellbore casing with one or more lateral wellbore receiver couplings' placed in its casing, forming a lateral wellbore extending through a fluid reservoir and provided with a wellbore liner to intersect the parent wellbore casing proximate a one of the wellbore receiver couplings, such step of forming the lateral wellbore to intersect the parent wellbore casing proximate the lateral wellbore receiver coupling further comprising the steps of providing a sensor mounted in said casing proximate said one receiver coupling to receive signals emitted from a lateral wellbore drilling assembly; and steering the drilling assembly towards said one wellbore receiver coupling in response to the signals emiited from said lateral wellbore drilling assembly and received by the sensor;

mechanically connecting the wellbore liner to the parent wellbore casing and flowing fluids between the reservoir and said wellbore liner and said casing.

8. The method of claim 7 including the further step of sealing the connection of the wellbore liner and the parent wellbore casing.

9. The method of claim 8 where said step of sealing is accomplished by mechanically energizing a seal means.

* * * * *